US007021226B2

(12) United States Patent
Tseng

(10) Patent No.: US 7,021,226 B2
(45) Date of Patent: Apr. 4, 2006

(54) SEWING MACHINE HAVING A LOWER THREAD CUTTER

(75) Inventor: Shui Chun Tseng, Taiping (TW)

(73) Assignee: Zeng Hsing Industrial Co., Ltd., (TW)

( * ) Notice: Subject to any disclaimer, the term of this patent is extended or adjusted under 35 U.S.C. 154(b) by 0 days.

(21) Appl. No.: 11/104,178

(22) Filed: Apr. 12, 2005

(65) Prior Publication Data

US 2006/0011119 A1 Jan. 19, 2006

(30) Foreign Application Priority Data

May 7, 2004 (TW) ..... 93207107 U

(51) Int. Cl.
*D05B 73/12* (2006.01)
*D05B 65/00* (2006.01)

(52) U.S. Cl. ..... 112/302; 112/260; 112/295

(58) Field of Classification Search ..... 112/296, 112/298, 291, 295, 260, 285, 302; 83/910, 83/936, 937
See application file for complete search history.

(56) References Cited

U.S. PATENT DOCUMENTS

| | | | | |
|---|---|---|---|---|
| 1,195,834 | A * | 8/1916 | Matthews | 112/292 |
| 1,883,746 | A * | 10/1932 | Doubler | 112/292 |
| 3,962,980 | A * | 6/1976 | Hedegaard et al. | 112/288 |
| 4,404,921 | A * | 9/1983 | Kastrup et al. | 112/291 |
| 4,465,006 | A * | 8/1984 | Dreier | 112/292 |
| 4,748,925 | A * | 6/1988 | Takei et al. | 112/260 |
| 5,025,737 | A * | 6/1991 | Kamiya | 112/296 |

* cited by examiner

*Primary Examiner*—Ismael Izaguirre
(74) *Attorney, Agent, or Firm*—McNees Wallace & Nurick LLC

(57) ABSTRACT

A sewing machine includes a needle plate with a cutout part, and a guide plate connected to a bottom side of the needle plate and extending substantially across the cutout part. The guide plate includes a pair of slide rails, an opening substantially corresponding in position to a bobbin case, and a curved thread guide slot having one end communicated with the opening and another end extending to one of the slide rails. A slide cover covers the cutout part and is slidable along the slide rails. A cutter is disposed at the lateral edge proximate to one of the slide rails. A lower thread guide extends along one of the slide rails from another end of the thread guide slot toward the cutter for guiding a lower thread from the bobbin case to extend to the cutter.

4 Claims, 8 Drawing Sheets

SEWING MACHINE HAVING A LOWER THREAD CUTTER

CROSS-REFERENCE TO RELATED APPLICATION

This application claims priority from Taiwanese Utility Application No. 93207107 filed on May 7, 2004.

BACKGROUND OF THE INVENTION

1. Field of the Invention

This invention relates to a sewing machine, more particularly to a sewing machine having a cutter for cutting a lower thread.

2. Description of the Related Art

Generally, a piece of cloth is sewn on a sewing machine by interlacing an upper thread passing through a needle with a lower thread from a bobbin. The needle brings the upper and lower threads to the cloth when it moves upward and downward on a needle plate so that the upper and lower threads are attached respectively to upper and lower sides of the cloth.

A traditional way to cut off the lower thread from the sewn cloth is to first pull out a certain length of the lower thread from the bobbin and then cut the lower thread manually with a cutter so that the length of the lower thread drawn out from the bobbin is sufficient for the lower thread to be interlaced with the upper thread in a subsequent sewing operation. However, it is difficult to control the length of the lower thread by pulling and cutting the lower thread by hand. Furthermore, the need to use an additional cutter is inconvenient.

SUMMARY OF THE INVENTION

An object of the present invention is to provide a sewing machine with a cutter for cutting a lower thread at a predetermined position so that the lower thread, after being cut, has a sufficient length for interlacing with an upper thread in a subsequent sewing operation.

According to this invention, a sewing machine comprises: a bobbin case containing a lower thread; a needle plate disposed above the bobbin case and including a lateral edge, a cutout part which opens at the lateral edge, and two opposite cutout part edges confining the cutout part and transverse to the lateral edge; a guide plate connected to a bottom side of the needle plate and extending substantially across the cutout part, the guide plate including a pair of slide rails respectively extending along the cutout part edges, an opening substantially corresponding in position to the bobbin case, and a curved thread guide slot having one end communicated with the opening and another end extending to one of the slide rails; a slide cover covering the cutout part and slidable along the slide rails; a cutter disposed at the lateral edge proximate to one of the slide rails; and a lower thread guide extending along one of said slide rails from another end of the thread guide slot toward the cutter for guiding the lower thread to extend to the cutter.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
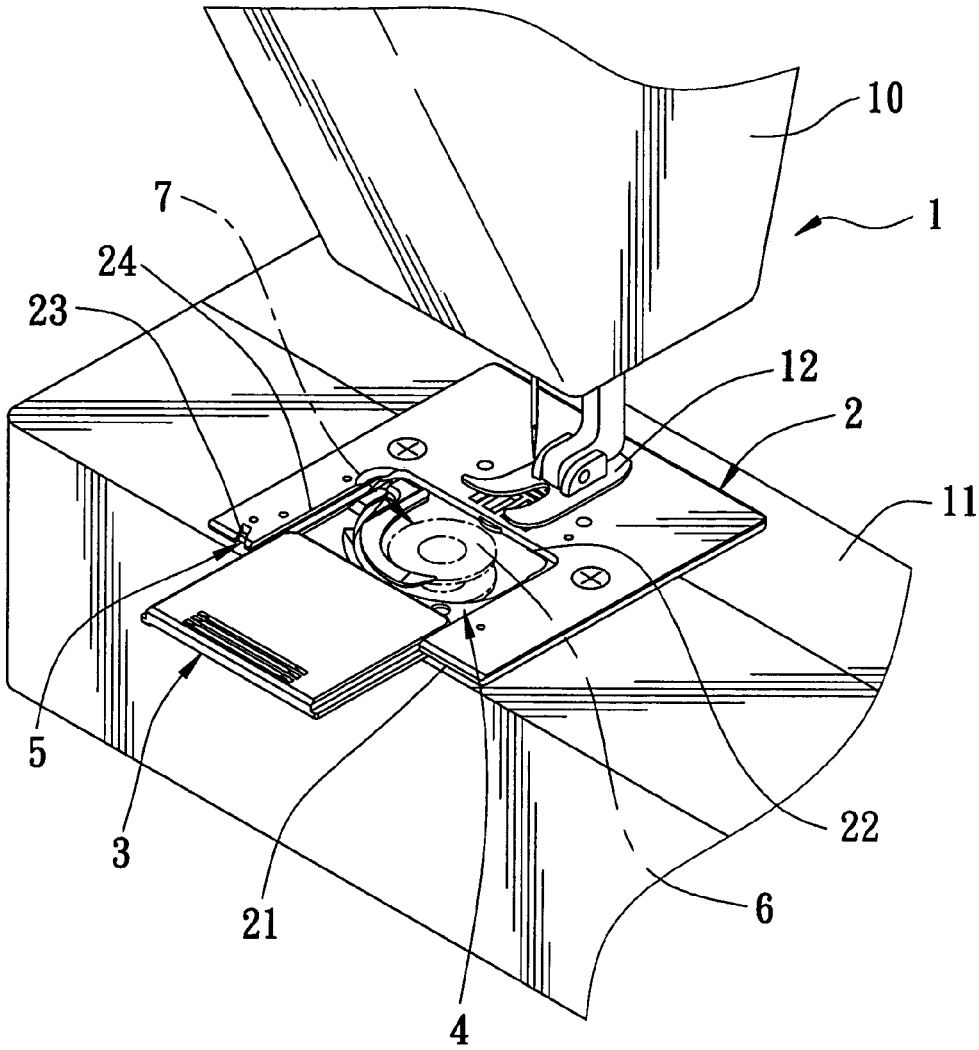
FIG. 1 is a fragmentary perspective view of a preferred embodiment of the sewing machine according to the present invention.

Referring to FIGS. 1 and 3 to 6, a sewing machine 1 embodying the present invention is shown to include a head 10 mounted on a bed 11, a presser foot 12 attached to the head 10, a needle plate 2 fixed to the bed 11, a slide cover 3, a guide plate 4, a cutter 5, and a bobbin case 6 disposed inside the bed 11 and holding a bobbin 7 of a lower thread.

The needle plate 2 is fixed to the bed 11 above the bobbin case 6 and includes a lateral edge 21, a cutout part 22 which opens at the lateral edge 21, and two opposite cutout part edges 24 confining the cutout part 22 and transverse to the lateral edge 21.

The guide plate 4 is attached to a bottom side of the needle plate 2 and extends substantially across the cutout part 22. The guide plate 4 includes a pair of slide rails 420 respectively extending along the cutout part edges 24, an opening 41 substantially corresponding in position to the bobbin case 6 so as to expose the bobbin case 6, and a curved thread guide slot 421 having one end communicated with the opening 41 and another end extending toward one of the slide rails 420. The thread guides lot 421 is provided to guide the lower thread 7 during the interlacing of the lower thread 7 with an upper thread (not shown).

The slide cover 3 is provided to cover the cutout part 22 and is slidable along the slide rails 420.

A lower thread guide 43 is provided along the slide rail 420 which is adjacent to the curved thread guide slot 421. The lower thread guide 43 includes a strip 431 disposed fixedly between the needle plate 2 and the guide plate 4 and along the adjacent slide rail 420. The strip 431 has an L-shaped cross-section so that a thread guide groove 432 is formed in the strip 431 immediately above the adjacent slide rail 420. The thread guide groove 432 has one end connected to the thread guide slot 421 and another end extending to the lateral edge 21 of the needle plate 2.

The cutter 5 includes a cutter blade 51 (see FIG. 5) which is fixed to the bottom side of the needle plate 2 proximate to the lateral edge 21 and the thread guide groove 432. The cutter blade 51 extends across a cutter groove 23 (FIG. 1) provided at the lateral edge 21 of the needle plate 2 and proximate to the end of the thread guide groove 432.

Figure 2:
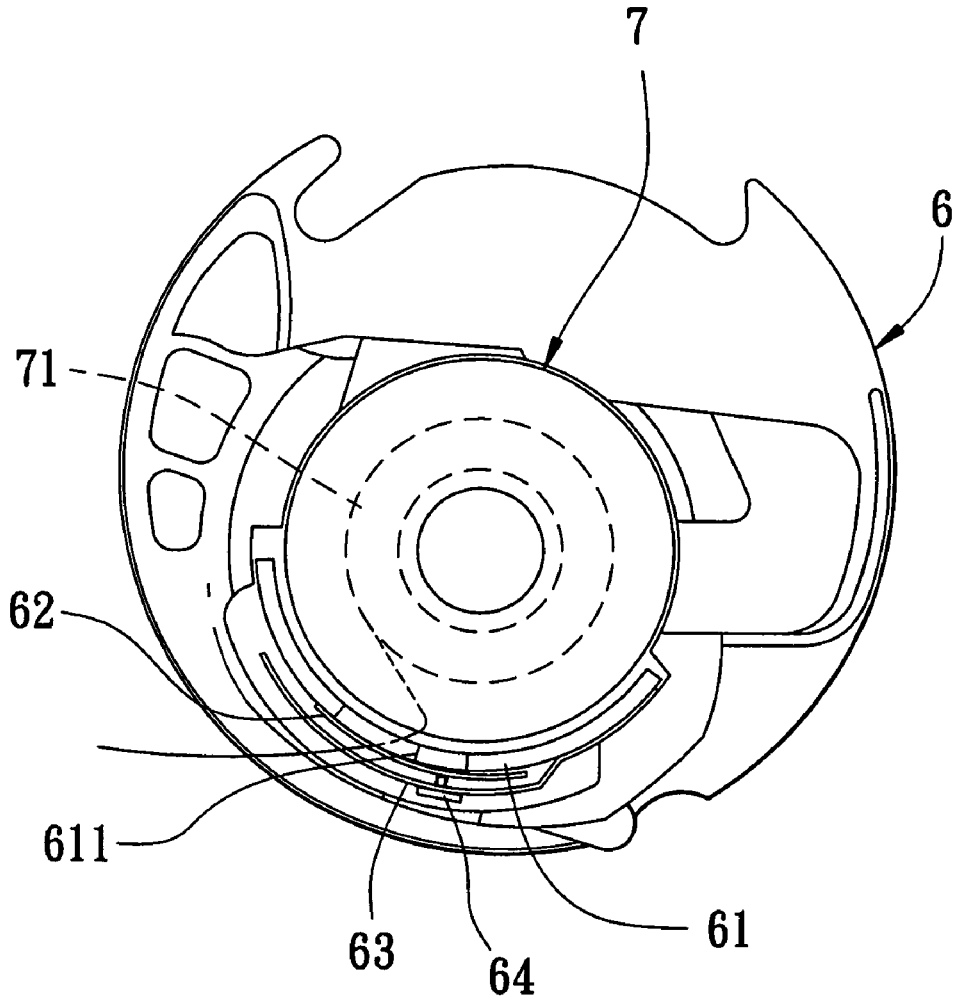
FIG. 2 is a plan view showing a bobbin case and a bobbin of the preferred embodiment.
Figure 3:
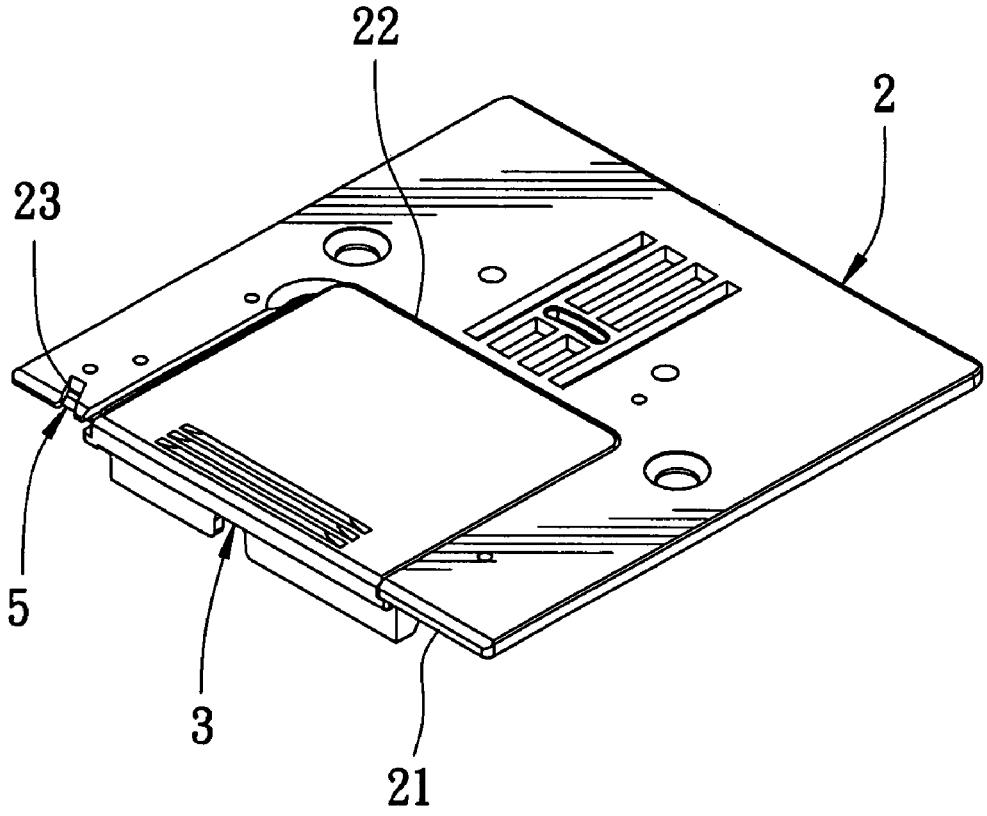
FIG. 3 is a perspective view of a needle plate and a slide cover of the preferred embodiment.
Figure 4:
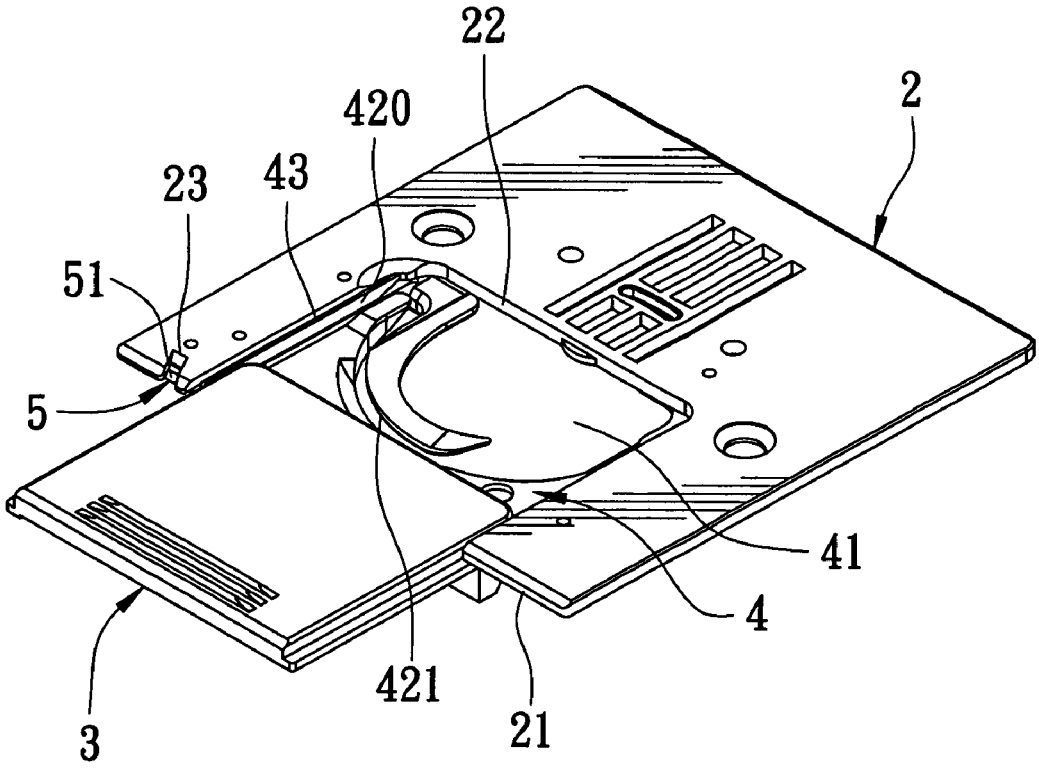
FIG. 4 is the same view as FIG. 3 but with the slide cover being moved to an open position.
Figure 5:
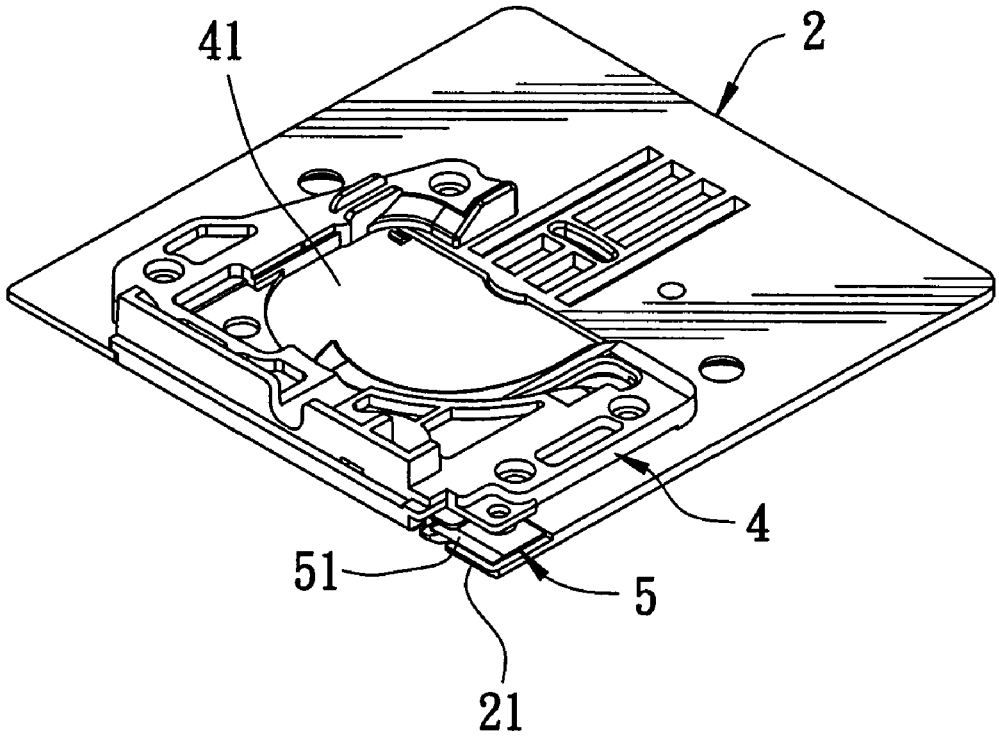
FIG. 5 is a perspective view showing the bottom side of the needle plate.
Figure 6:
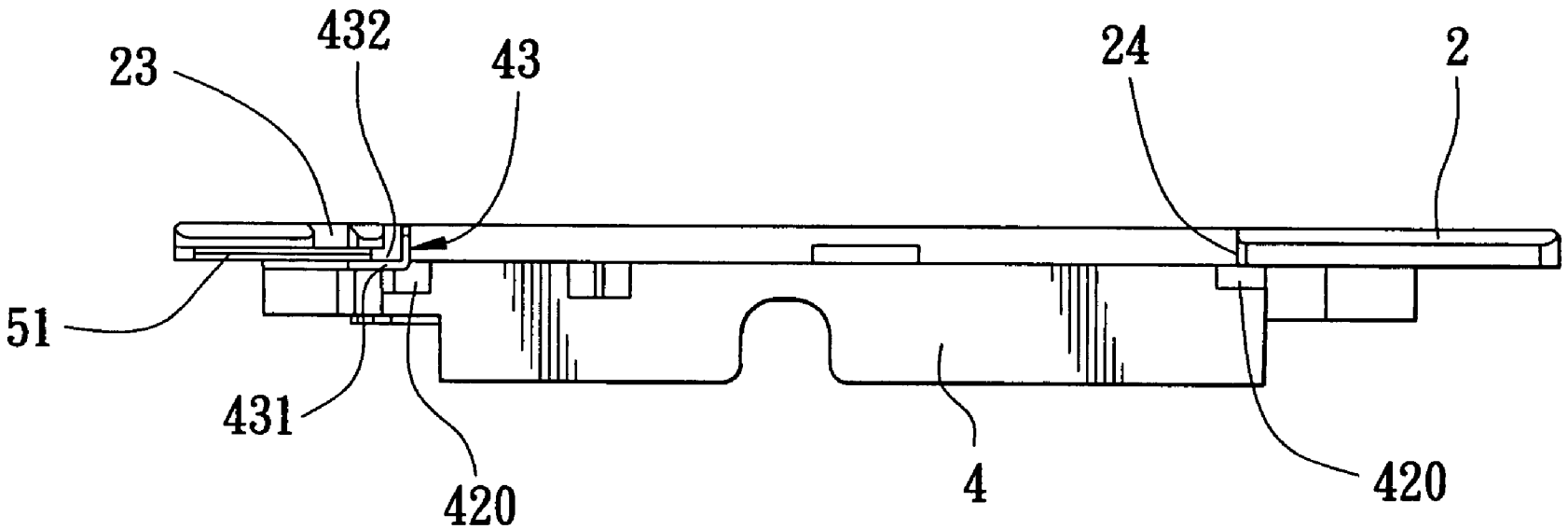
FIG. 6 is an elevation view showing a lower thread guide.

Referring to FIG. 2, the bobbin case 6 is provided proximate to the thread guide slot 421 and includes a positioning plate 61 extending around one side of the bobbin 7, a spring plate 62 covering the positioning plate 61, and a limit plate 63 covering the spring plate 62 and the positioning plate 61, and a screw 64 threaded through the limit plate 63 and abutting against the spring plate 62. The positioning plate 61 has a thread guide aperture 611 to guide a lower thread 71 of the bobbin 7 to extend out of the positioning plate 61 and the spring plate 62. The screw 64 controls the gap between the spring plate 62 and the positioning plate 61 so that the resistance against the pulling force and the tension of the lower thread 71 can be adjusted.

Figure 7:
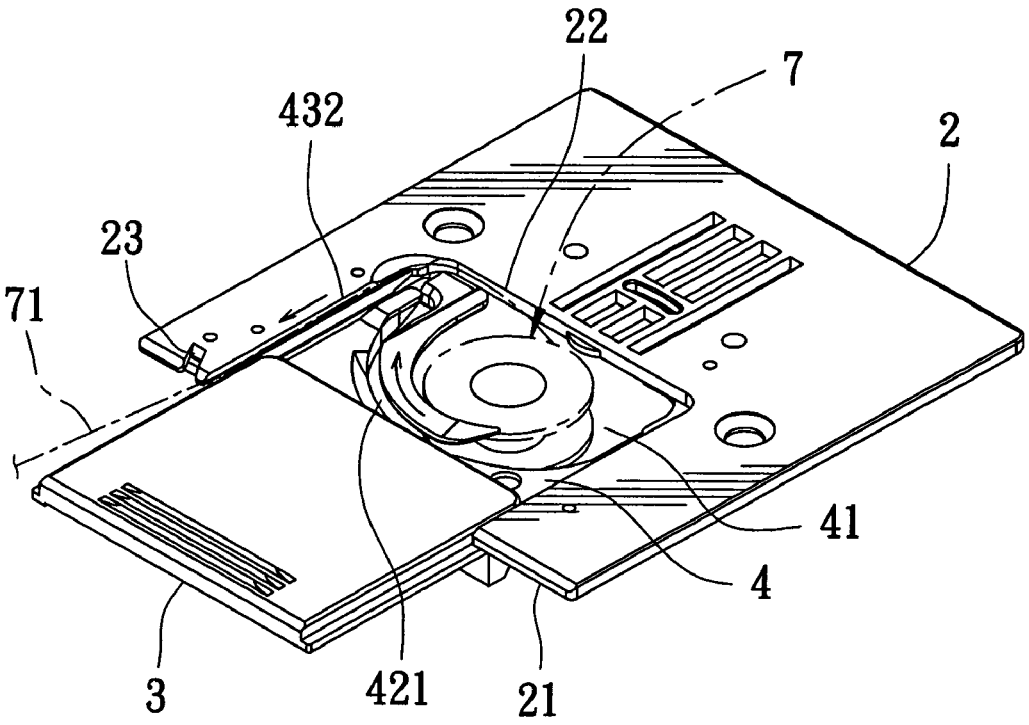
FIG. 7 is the same view as FIG. 4 but showing additionally a lower thread.
Figure 8:
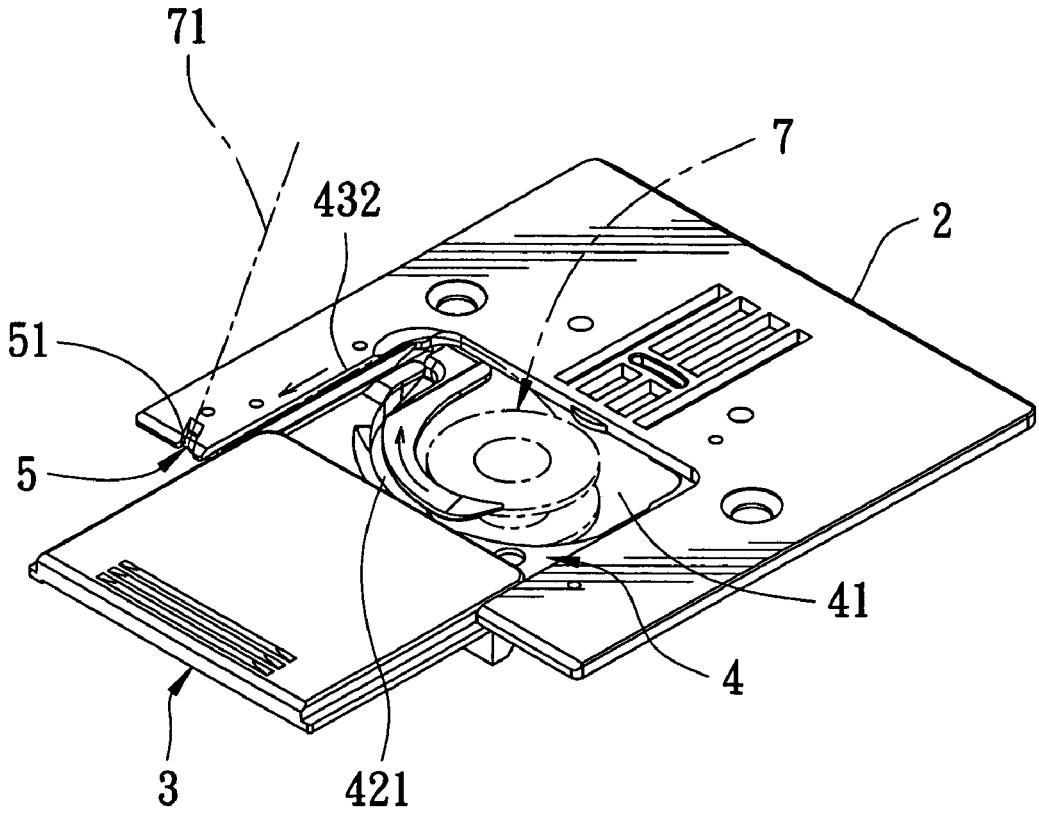
FIG. 8 is the same view as FIG. 7 but with the lower thread being placed in a position for cutting.

Referring to FIGS. 7 and 8 in combination with FIG. 2, when it is necessary to cut the lower thread 71 from the bobbin 7, the slide cover 3 is opened, and the lower thread 71 is drawn out from the bobbin 7 and pulled into the curved thread guide slot 421 from the opening 41 in the guide plate 4 and then into the thread guide groove 432 from the curved thread guide slot 421. Afterwards, the lower thread 71 is drawn from the thread guide groove 432 and pulled into the cutter groove 23 where the lower thread 71 is forced to contact against the cutter blade 51. The lower thread 71 is thus cut by the cutter blade 51.

Since the lower thread 71 travels through the thread guide slot 421 and the thread guide groove 423 before it is cut, the part of the lower thread 71 drawn out from the bobbin case 6 may have a length which is determined by the total length of the thread guide slot 421 and the thread guide groove 432. As the length of the drawn out part of the lower thread 71 can be predetermined to be a length sufficient for the lower thread 71 to be interlaced with an upper thread, practicality and utility of the sewing machine 1 are increased.

As the cutter 5 is provided at the lateral edge 21 of the needle plate 2, the location of the cutter 5 is convenient for the operator, and the cutting operation can be performed easily without causing interference with the bed 11 of the sewing machine 1. In addition, the arrangement of the cutter 5 and the lower thread guide 43 is simple.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A sewing machine comprising:

a bobbin case containing a lower thread;

a needle plate disposed above said bobbin case and including a lateral edge, a cutout part which opens at said lateral edge, and two opposite cutout part edges confining said cutout part and transverse to said lateral edge;

a guide plate connected to a bottom side of said needle plate, said guide plate including a pair of slide rails respectively extending along said cutout part edges, an opening substantially corresponding in position to said bobbin case, and a curved thread guide slot having one end communicated with said opening and another end extending to one of said slide rails;

a slide cover covering said cutout part and slidable along said slide rails;

a cutter disposed at said lateral edge proximate to said one of said slide rails; and a lower thread guide extending along said one of said slide rails from said another end of said thread guide slot toward said cutter for guiding the lower thread to extend to said cutter.

2. The sewing machine as claimed in claim 1, wherein said lower thread guide includes a strip which extends along said one of said slide rails and which has a thread guide groove which extends from said another end of said thread guide slot toward said cutter.

3. The sewing machine as claimed in claim 2, wherein said strip is disposed fixedly between said needle plate and said guide plate, said thread guide groove extending immediately above said one of said slide rails.

4. The sewing machine as claimed in claim 3, wherein said needle plate further includes a cutter groove formed in said lateral edge, said cutter having a cutter blade attached to a bottom side of said lateral edge and extending across said cutter groove.

* * * * *